US012594476B2

(12) United States Patent
Masiukiewicz et al.

(10) Patent No.: US 12,594,476 B2
(45) Date of Patent: Apr. 7, 2026

(54) AUTOMATIC BALL MACHINE APPARATUS LOCALIZATION

(71) Applicant: Volley LLC, Lancaster, PA (US)

(72) Inventors: Lukasz Masiukiewicz, York, PA (US); Stephen Titus, Herndon, VA (US); Christopher Louis Decker, Papillion, NE (US); John Weinlader, Wilmette, IL (US); Daniel Weinlader, Lititiz, PA (US)

(73) Assignee: Volley LLC, Lancaster, PA (US)

( * ) Notice: Subject to any disclaimer, the term of this patent is extended or adjusted under 35 U.S.C. 154(b) by 752 days.

(21) Appl. No.: 18/097,345

(22) Filed: Jan. 16, 2023

(65) Prior Publication Data

US 2023/0149791 A1 May 18, 2023

Related U.S. Application Data

(63) Continuation-in-part of application No. 17/408,147, filed on Aug. 20, 2021, now Pat. No. 12,194,342, (Continued)

(51) Int. Cl.
*A63B 69/40* (2006.01)

(52) U.S. Cl.
CPC ..... *A63B 69/406* (2013.01); *A63B 2069/402* (2013.01); *A63B 2220/05* (2013.01); *A63B 2220/13* (2013.01); *A63B 2225/093* (2013.01)

(58) Field of Classification Search
CPC ..... A63B 69/406; A63B 2069/402; A63B 2220/05; A63B 2220/13; A63B 2225/093; (Continued)

(56) References Cited

U.S. PATENT DOCUMENTS 5,816,953 A 10/1998 Cleveland
6,539,931 B2 4/2003 Trajkovic et al.
(Continued)

FOREIGN PATENT DOCUMENTS

CN 107537149 A * 1/2018 ..... G01C 11/02
CN 110538443 A 12/2019
(Continued)

OTHER PUBLICATIONS

Translation of CN-107537149-A. (Year: 2018).*
(Continued)

*Primary Examiner* — Jeffrey S Vanderveen
(74) *Attorney, Agent, or Firm* — Muir Patent Law, PLLC

(57) ABSTRACT

A ball machine system comprising a ball launching system, a memory configured to store a court model that includes dimensions of a court type in relation to a three-dimensional (3D) coordinate system, an imaging system connected to the ball launching system and configured to capture a plurality of images of a court, and a processor. The processor configured to analyze the plurality of images to detect feature points in each of the plurality of images, superimpose a plurality of different transformations of the court model onto the plurality of images to generate a plurality of model fits, select as a final model fit, from the plurality of model fits, a model fit based on a degree of overlap among features of the transformed court model and the respective image, and calculate the position of the ball launching system on a playing surface of the court based on the selected final model fit and intrinsic parameters of the imaging system.

32 Claims, 9 Drawing Sheets

Related U.S. Application Data which is a continuation-in-part of application No. 17/093,321, filed on Nov. 9, 2020, now abandoned.

(58) Field of Classification Search

CPC ..... A63B 2024/0025; A63B 2071/068; A63B 2220/30; A63B 2220/806; A63B 2220/808; A63B 2220/89; A63B 2225/20; A63B 2225/50; A63B 71/0619; A63B 24/0021; G06V 20/42

See application file for complete search history.

(56) References Cited

U.S. PATENT DOCUMENTS

| | | | |
|---|---|---|---|
| 8,419,560 | B2 | 4/2013 | Amini |
| 9,233,294 | B1 | 1/2016 | Coyle |
| 10,695,644 | B2 | 6/2020 | Khazanov et al. |
| 11,033,780 | B2 | 6/2021 | New et al. |
| 11,367,364 | B2 | 6/2022 | May |
| 11,657,906 | B2 | 5/2023 | Lewis et al. |
| 2013/0130845 | A1 | 5/2013 | Marty |
| 2014/0121043 | A1 | 5/2014 | Blanning |
| 2015/0165300 | A1 | 6/2015 | Vaught et al. |
| 2016/0310817 | A1 | 10/2016 | Yeager |
| 2018/0140917 | A1 | 5/2018 | Song |
| 2019/0126120 | A1 | 5/2019 | Paredes et al. |
| 2019/0240558 | A1 | 8/2019 | Khazanov |
| 2020/0197782 | A1 | 6/2020 | Abdelmoneum |
| 2020/0398139 | A1 | 12/2020 | Harley |
| 2021/0031081 | A1 | 2/2021 | Lewis |
| 2021/0128989 | A1 | 5/2021 | Legg et al. |
| 2021/0354021 | A1 | 11/2021 | Hannallah |
| 2021/0379446 | A1 | 12/2021 | Weinlader |
| 2022/0198368 | A1 | 6/2022 | May |
| 2022/0233942 | A1 | 7/2022 | Ferrabee |
| 2023/0372803 | A1* | 11/2023 | Kweon ..... A63B 71/0669 |
| 2024/0152759 | A1 | 5/2024 | Rapp |

FOREIGN PATENT DOCUMENTS

| | | | | |
|---|---|---|---|---|
| KR | 20190031113 | A * | 3/2019 | ..... A63B 24/00 |
| KR | 102265914 | | 6/2021 | |
| KR | 102265914 | B1 | 6/2021 | |
| WO | 2022038587 | A1 | 2/2022 | |
| WO | 2022050792 | A1 | 3/2022 | |

OTHER PUBLICATIONS

Translation of KR-20190031113-A. (Year: 2019).*

POP Tennis How to Play and Court and Equipment Guide, International POP Tennis Association, Inc., https://www.poptennis.com, accessed Sep. 2022.

2022 Official International Federation of Pickleball Rulebook, International Federation of Pickleball, Revised 2002.

Regulations of the Padel Game, International Padel Federation, May 28, 2021.

2022 International Tennis Federation Rules of Tennis, International Tennis Federation, 2021.

Official Rules of Platform Tennis, American Platform Tennis Association, www.platformtennis.org/about_us/Rules_of_Platform_Tennis.htm, accessed Sep. 2022.

* cited by examiner

AUTOMATIC BALL MACHINE APPARATUS LOCALIZATION

CROSS-REFERENCE TO RELATED APPLICATION

This application is a continuation-in-part of U.S. patent application Ser. No. 17/408,147 filed Aug. 20, 2021, which is a continuation-in-part of U.S. patent application Ser. No. 17/093,321 filed Nov. 9, 2020, and which claims priority from U.S. Patent App. Ser. No. 62/933,497 filed Nov. 10, 2019, the entire disclosures of which are hereby incorporated by reference.

BACKGROUND

A ball machine that projects balls at a player may be used to develop player skills, provide a fitness workout, or provide recreational activity. The ball machine may be utilized in racket sports, such as tennis, pickleball, paddle tennis, padel, platform tennis, etc. Typically, these ball machines have speed control knobs that allow an operator to adjust various motors and actuators to "dial-in" a ball launch (i.e., shot) that the player wants to practice. This "dial-in" practice is time consuming and cumbersome.

In many instances it is difficult to vary the type of projection of a ball and the accurate placement of the projected ball on a predetermined, random or other controlled manner. Some ball machines allow for manual feed and adjustment. Other ball machines allow for only a limited number of different predetermined shots, or volleys.

In order for a ball machine to automatically and accurately project balls at varying locations to a player on a court, the ball machine must be able to determine its position on the court. Conventional ball machines are unable to automatically determine their locations on different courts without external sensors or imaging devices embedded, arranged, or affixed to the court.

SUMMARY

A ball machine system comprising a ball launching system; a memory configured to store a court model that includes dimensions of a court type in relation to a three-dimensional (3D) coordinate system; an imaging system connected to the ball launching system and configured to capture a plurality of images of a court; and a processor. The processor configured to analyze the plurality of images to detect feature points in each of the plurality of images, superimpose a plurality of different transformations of the court model onto the plurality of images to generate a plurality of model fits, select as a final model fit, from the plurality of model fits, a model fit based on a degree of overlap among features of the transformed court model and the respective image, and calculate the position of the ball launching system on a playing surface of the court based on the selected final model fit and intrinsic parameters of the imaging system.

A ball machine system comprising a ball launching system; a memory configured to store a court model that includes dimensions of a court type in relation to a three-dimensional (3D) coordinate system; an imaging system attached to the ball launching system and configured to capture a plurality of images of a court; and a processor. The processor configured to analyze the plurality of images to detect features including a plurality of lines, the orientation of the plurality of lines, and intersection points among the plurality of lines, extract, as feature points, from each of the plurality of images the detected features corresponding to each image, superimpose, based on a selection of a first set of feature points from the court model and the extracted feature points from a first image included in the plurality of images, a first transformation of the court model onto the first image to generate a first model fit, superimpose, based on a selection of a second set of feature points from the court model and the extracted feature points from a second image included in the plurality of images, a second transformation of the court model onto the first image to generate a second model fit, determine, for the first model fit, a degree of overlap among features of the first transformation of the court model with features in the first image, determine, for the second model fit, a degree of overlap among features of the second transformation of the court model with features in the second image, select as a final model fit, a model fit based on a degree of overlap, and calculate the position of the ball launching system on a playing surface of the court based on the selected final model fit and intrinsic parameters of the imaging system.

A method of determining the position of a ball machine on a playing surface of a court, the method comprising selecting a court model that includes dimensions of a court type in relation to a three-dimensional (3D) coordinate system; analyzing a plurality of images captured by an imaging system attached to the ball machine to detect feature points in each of the plurality of images; superimposing a plurality of different transformations of the court model onto the plurality of images to generate a plurality of model fits; selecting as a final model fit, from the plurality of model fits, selecting as a final model fit, from the plurality of model fits, a model fit based on a degree of overlap among features of the transformed court model and the respective image; and calculating the position of the ball machine on the playing surface based on the selected final model fit and intrinsic parameters of the imaging system.

A method of determining the position of a ball machine on a playing surface of a court, the method comprising selecting a court model that includes dimensions of a court type in relation to a three-dimensional (3D) coordinate system; analyzing a plurality of images captured by an imaging system attached to the ball machine to detect features including a plurality of lines, the orientation of the plurality of lines, and intersection points among the plurality of lines; extracting, as feature points, from each of the plurality of images the detected features corresponding to each image; superimposing, based on a selection of a first set of feature points from the court model and the extracted feature points from a first image included in the plurality of images, a first transformation of the court model onto the first image to generate a first model fit; superimposing, based on a selection of a second set of feature points from the court model and the extracted feature points from a second image included in the plurality of images, a second transformation of the court model onto the first image to generate a second model fit; determining, for the first model fit, a degree of overlap among features of the first transformation of the court model with features in the first image; determining, for the second model fit, a degree of overlap among features of the second transformation of the court model with features in the second image; selecting as a final model fit, a model fit having a degree of overlap greater than a predetermined threshold; and calculating the position of the ball machine on the playing surface based on the selected model fit and intrinsic parameters of the imaging system.

A ball machine system comprising a ball launching system; a memory configured to store a court model that includes dimensions of a court type in relation to a three-dimensional (3D) coordinate system; a camera connected to the ball launching system and configured to capture an image of a court; and a processor. The processor configured to analyze the image to detect feature points in the image, superimpose a plurality of different transformations of the court model onto the image to generate a plurality of model fits, select as a final model fit, from the plurality of model fits, a model fit based on a degree of overlap among features of the transformed court model and the image, and calculate the position of the ball launching system on a playing surface of the court based on the selected final model fit and intrinsic parameters of the camera.

A ball machine system comprising a ball launching system; a memory configured to store a court model that includes dimensions of a court type in relation to a three-dimensional (3D) coordinate system; a camera connected to the ball launching system and configured to capture images of a court; a height actuator configured to adjust a height of the camera; and a processor. The processor configured to analyze a first image captured by the camera at a first height and a second image captured by the camera at a second height to detect feature points in the first image and the second image, superimpose a plurality of different transformations of the court model onto the first image and the second image to generate a plurality of model fits, select as a final model fit, from the plurality of model fits, a model fit based on a degree of overlap among features of the transformed court model with respect to the first image and the second image, and calculate the position of the ball launching system on a playing surface of the court based on the selected final model fit and intrinsic parameters of the camera.

BRIEF DESCRIPTION OF THE DRAWINGS

The above and other objects, features, and advantages of the inventive concept will become more apparent to those skilled in the art upon consideration of the following detailed description with reference to the accompanying drawings.

DETAILED DESCRIPTION OF EXEMPLARY EMBODIMENTS

Figure 1:
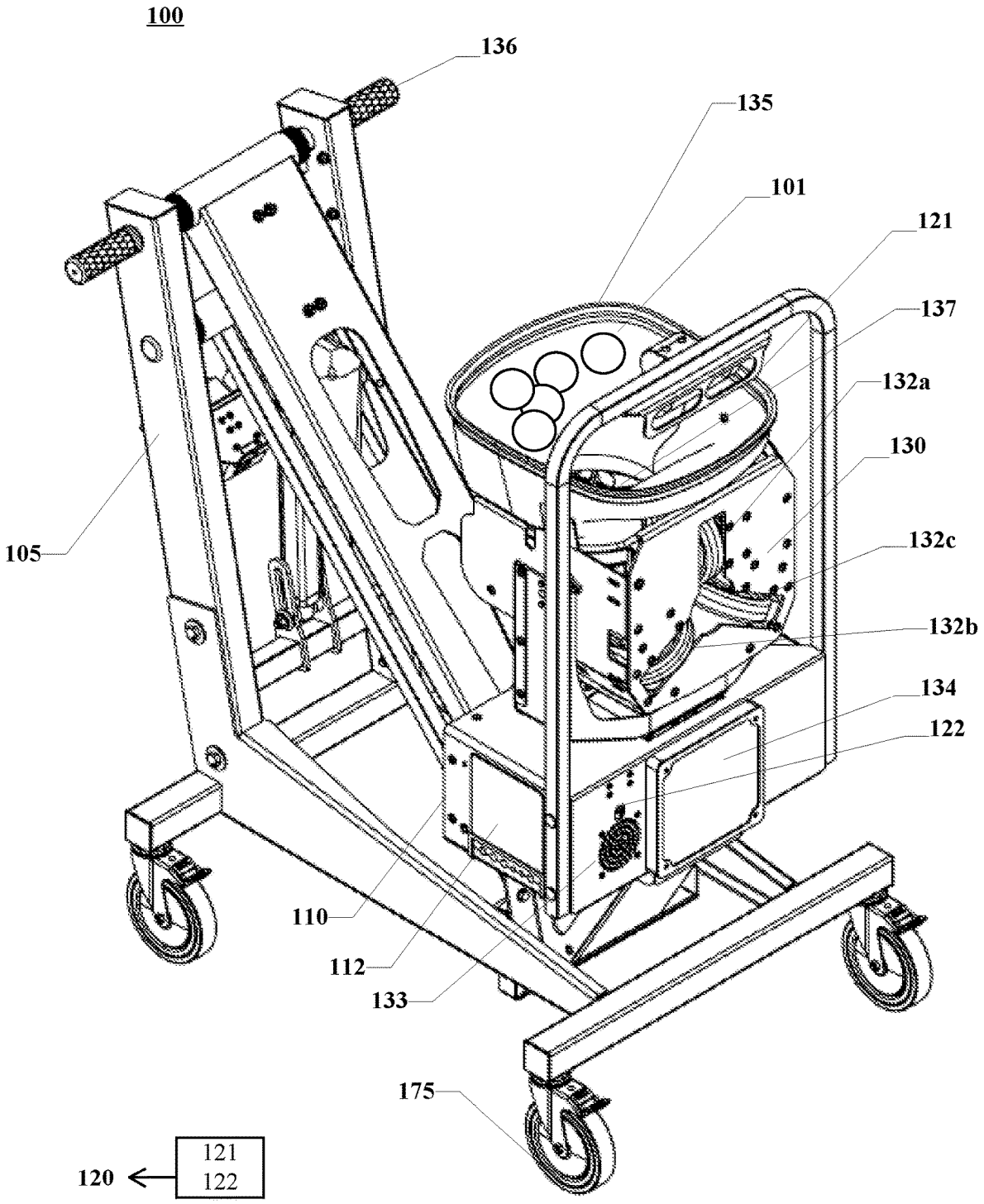
FIG. 1 illustrates an isometric front view of an automatic ball machine in a lowered position according to example embodiments.
Figure 2:
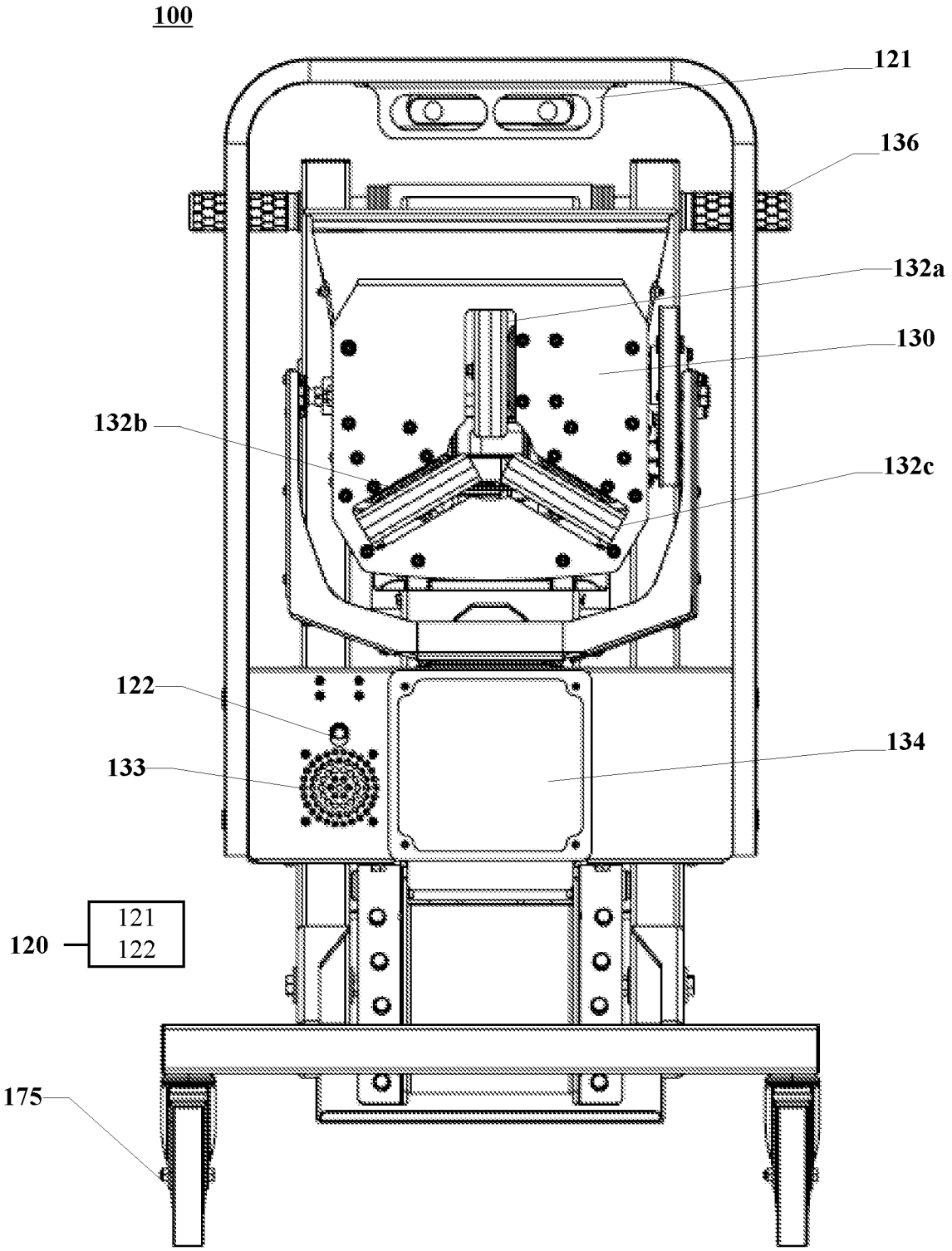
FIG. 2 illustrates a front side view of the automatic ball machine in a lowered position according to example embodiments.
Figure 3:
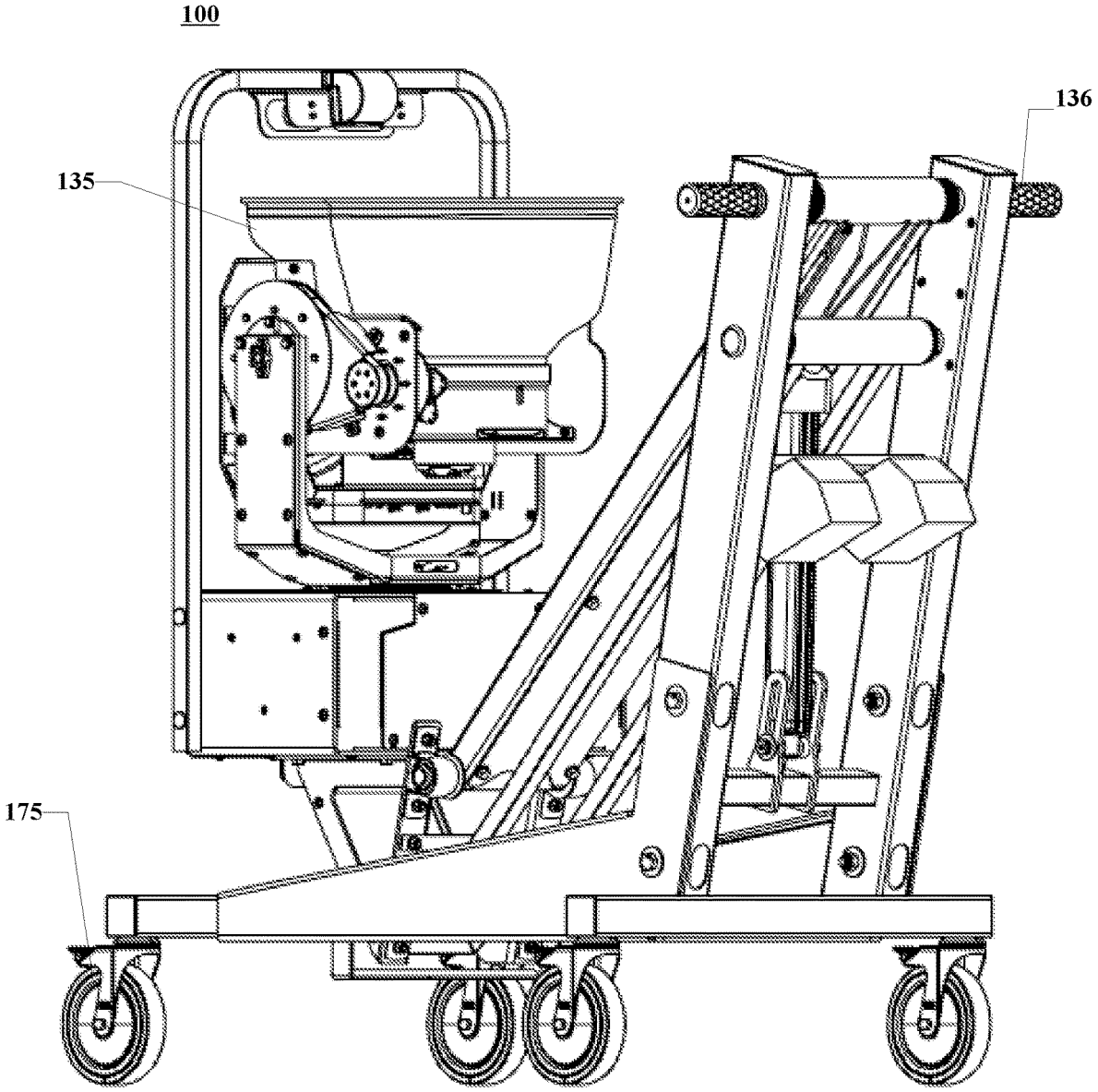
FIG. 3 illustrates an isometric rear view of the automatic ball machine in a lowered position according to example embodiments.
Figure 4:
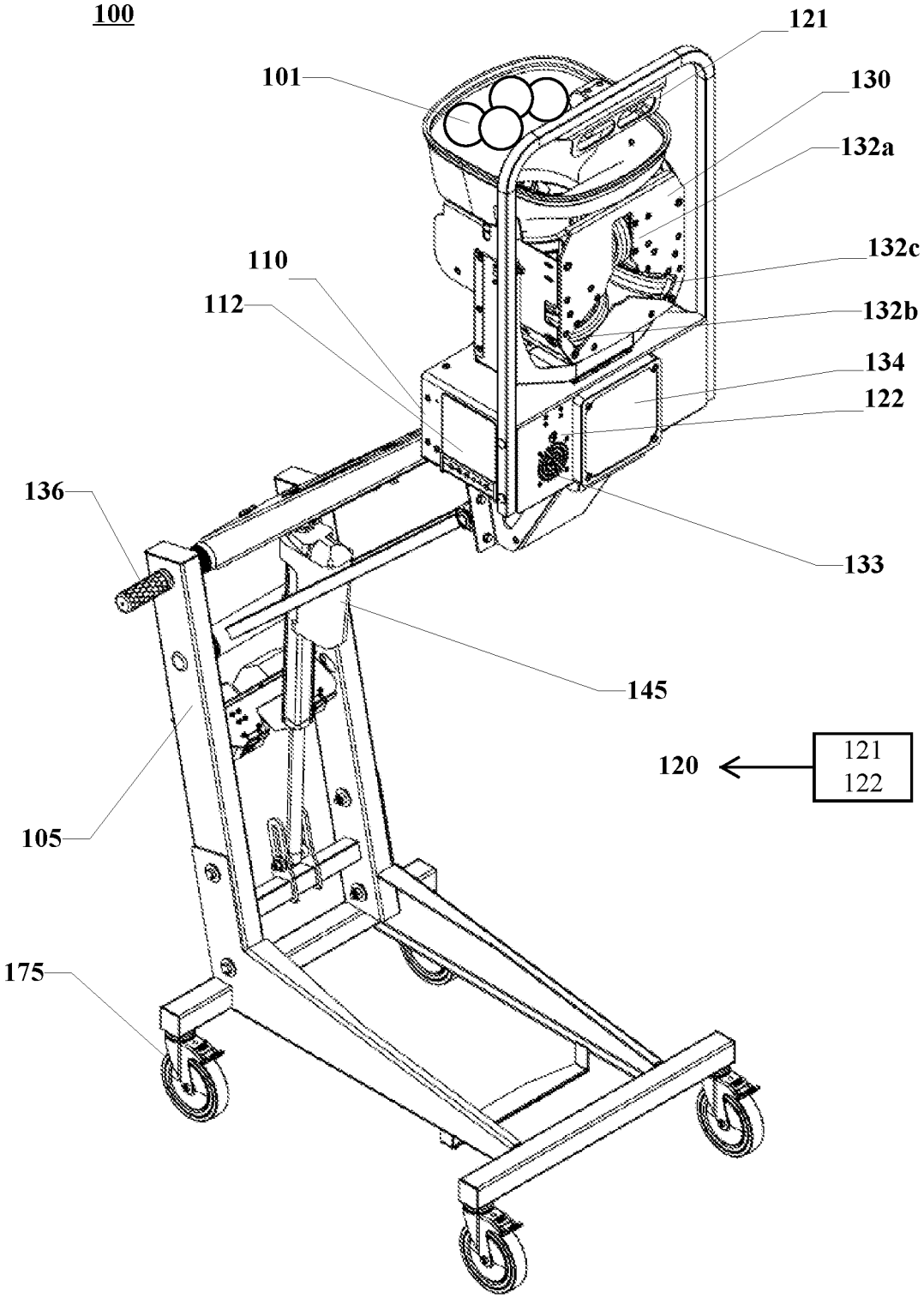
FIG. 4 illustrates an isometric front view of the automatic ball machine in a raised position according to example embodiments.
Figure 5:
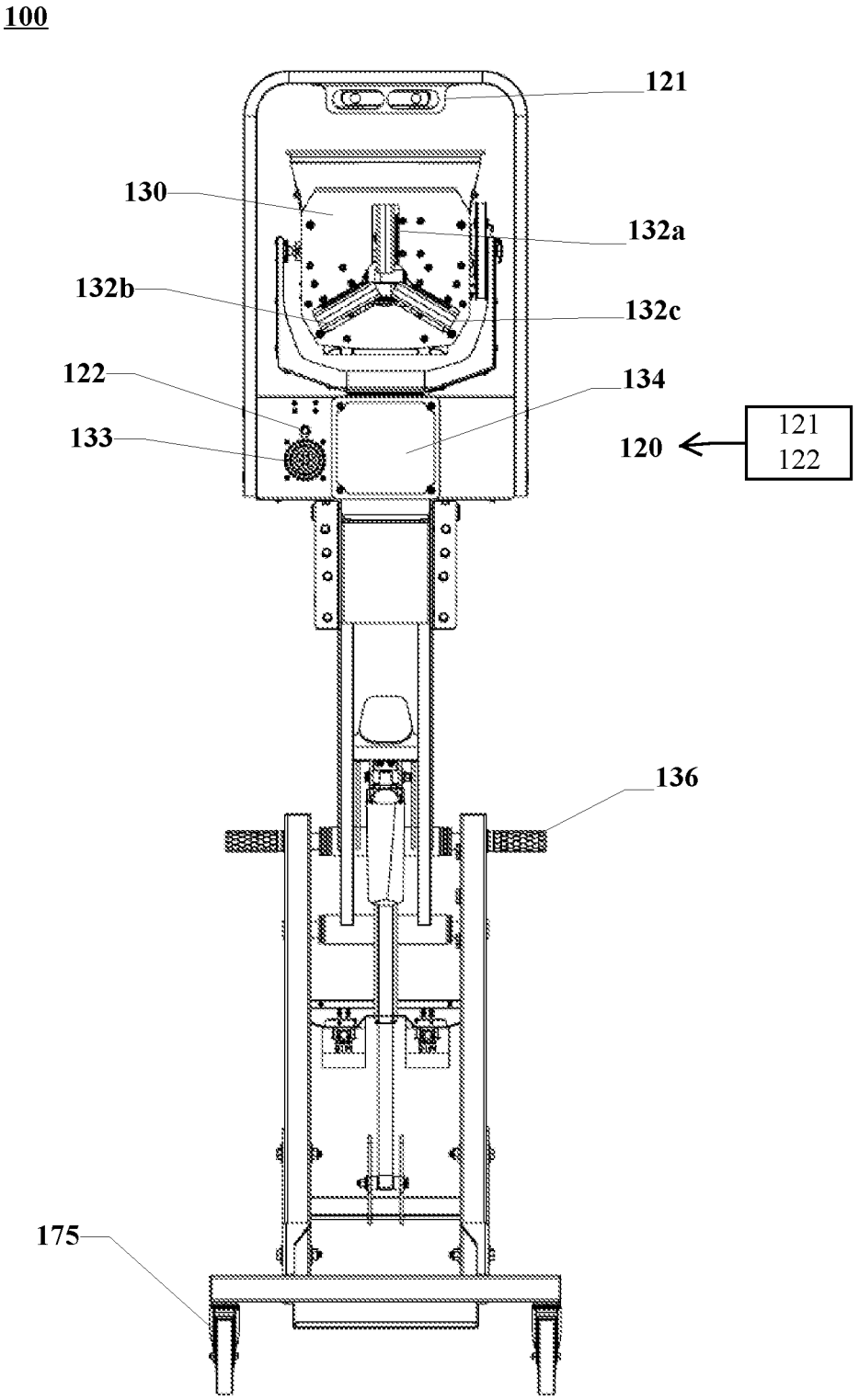
FIG. 5 illustrates a front side view of the automatic ball machine in a raised position according to example embodiments.
Figure 6:
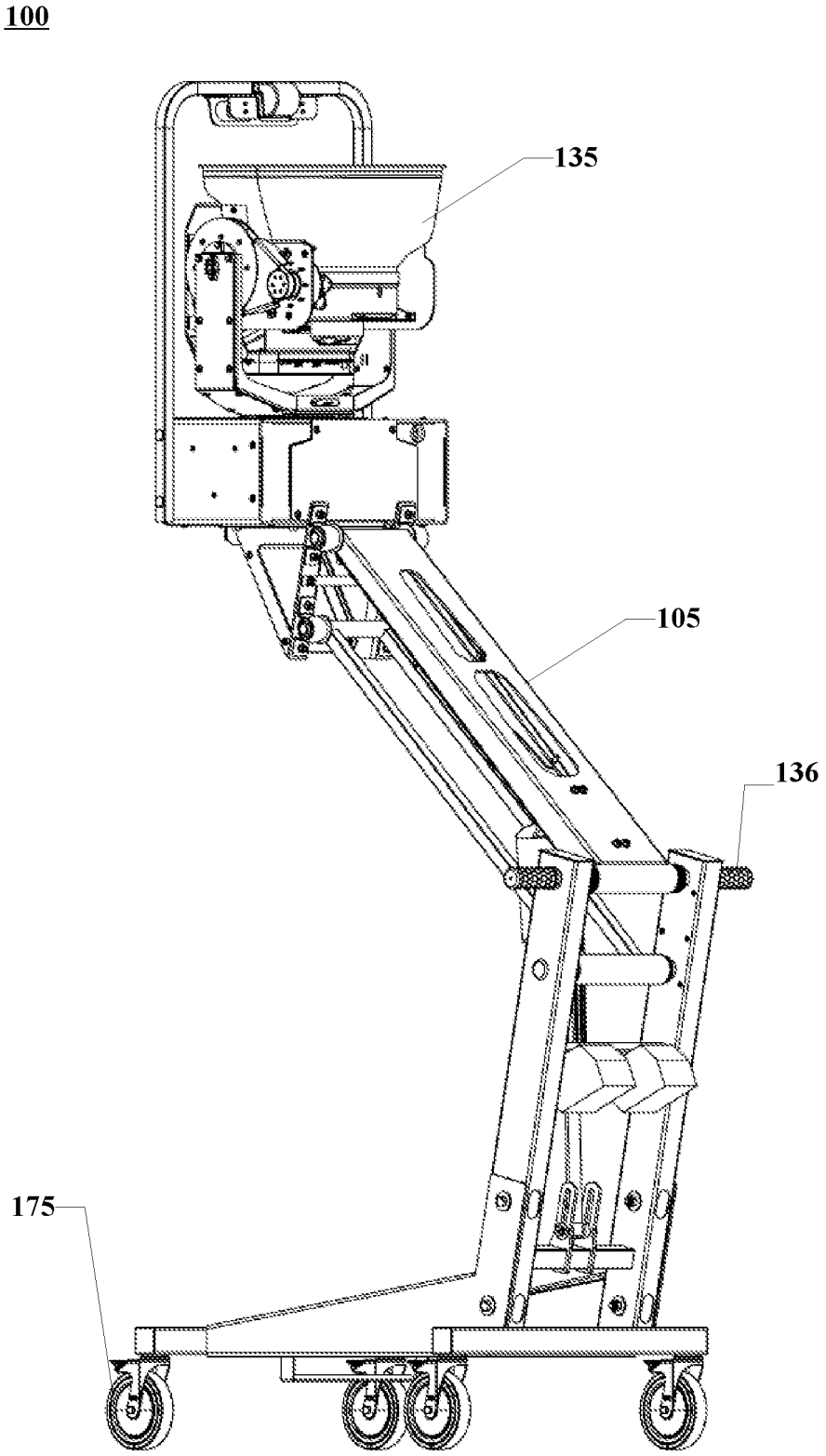
FIG. 6 illustrates an isometric rear view of the automatic ball machine in a raised position according to example embodiments.

Various aspects of the inventive concept will be described more fully hereinafter with reference to the accompanying drawings.

FIGS. 1-6 illustrate varying orientation views of an automatic ball machine 100 according to example embodiments. Referring to FIGS. 1-6, the automatic ball machine 100 may include a frame 105 onto which various components are coupled, such as a controller 110, a first camera 121, and a second camera 122 mounted inside controller 110. Although the entirety of the second camera 122 is not illustrated in the drawings, the optical input of the second camera 122 is illustrated in the drawings above speaker 133. The automatic ball machine 100 may include a ball launching system 130 to launch (i.e., project) balls 101, a hopper 135 to store a quantity of the balls 101 prior to launch, a mobility system 175 to move the automatic ball machine 100, and handles 136 configured to maneuver and adjust the automatic ball machine 100. Components of the automatic ball machine 100 may be physically connected to each other through the frame 105 of the automatic ball machine 100. For example, the first camera 121 and the second camera 122 (collectively referred to herein as "imaging system 120") are physically connected to the ball launching system 130 through the frame 105. The height position, in the vertical direction, of the automatic ball machine 100 is shown in a lowered position in FIGS. 1-3 and in a raised position in FIGS. 4-6. However, the height position of the automatic ball machine 100 may be adjusted and set anywhere in-between the illustrated lowered position and the illustrated raised position depending, for example, upon the trajectory needed to launch the balls 101 by the ball launching system 130. The height position of the automatic ball machine 100 may also range from the lowered position to the raised position during a localization operation, discussed in further detail below, in order to capture images of the court using the imaging system 120 at different height positions. The automatic ball machine 100 may further include a ball feeder 137 to control, via the controller 110, feeding of balls 101 to the ball launching system 130, such as from the hopper 135.

According to example embodiments, the imaging system 120 may be disposed on the automatic ball machine 100 to capture digital images in a direction in which balls 101 are launched from the automatic ball machine 100. The first camera 121 and second camera 122 may be positioned to capture digital images at two different vantage points. Three-dimensional (3D) information may be extracted from the digital images through computer vision. In an example embodiment, the first camera 121 of the imaging system 120 may be a stereo camera. In another example embodiment, first camera 121 and second camera 122 of the imaging system 120 may be replaced with a Time-Of-Flight (TOF) camera to detect a depth of field.

In a further example embodiment, the imaging system 120 may include cameras in addition to cameras 121 and 122 to improve the data that is being received by the controller 110. For example, the imaging system 120 may include a plurality of cameras to detect objects to a left of the launch direction, to a right of the launch direction, and away from the launch direction, respectively. The plurality of cameras may increase an effective field-of-view of the imaging system 120.

The ball launching system 130 may include a plurality of spinner wheels coupled to a plurality of motors, to launch the balls 101. For example, the ball launching system 130 may include first, second, third spinner wheels 132*a*, 132*b*, 132*c*, coupled to first, second, third spinner motors, respectively. As illustrated for example in FIG. 2, the spinner wheel 132*a* is shown as being disposed at approximately (+/−5 degrees) of the 12 o'clock position, with the spinner wheel 132*c* being disposed at approximately (+/−5 degrees) of the 4 o'clock position, and the spinner wheel 132*b*, being disposed at approximately (+/−5 degrees) of the 8 o'clock position.

In addition to performing functions of the automatic ball machine localization procedure described in further detail below, the first camera 121 may also act as an environment sensor to detect objects in a direction that balls 101 are being launched from the automatic ball machine 100. For example, the automatic ball machine 100 may use the first camera 121 as an environment sensor to monitor, via the controller 110, an area in a direction that the ball 101 is being launched, and in at least one configuration around the automatic ball machine 100 to ensure no person or unintended objects are struck by the balls 101 being launched by the automatic ball machine 100, or harmed by any automated mechanical movement of the automatic ball machine 100. The automatic ball machine 100 may establish a keep-out region, that if violated, will result in the automatic ball machine 100 stopping launching of the balls 101 and/or mechanical movement, such as the ball launching system 130, and in at least one configuration issuing a warning to a player. The warning may comprise a visual cue via, for example, a display device 134 or a lighting system (not illustrated). The warning may also comprise an audio cue via, for example, a speaker 133. The display device 134 may be a flat-panel display, such as an LCD display, an LED display, an OLED display, a QLED display, or the like.

The automatic ball machine 100 may adjust a distance the keep-out region extends from the automatic ball machine 100 based on a court location of the automatic ball machine 100. To vary the coverage area around the automatic ball machine 100, additional environment sensors may be included. For example, the automatic ball machine 100 may include an additional environment sensor, such as a Light Detection and Ranging (LiDAR) sensor or similar, to detect objects outside a field-of-view of the imaging system 120, and/or to provide backup or additional data for the controller 110. A full 360-degree coverage around the automatic ball machine 100 may be implemented via additional environment sensors, for example, LiDAR sensors. In other configurations, additional environment sensors may further include, for example, barometric sensors, temperature sensors, humidity sensors, anemometer sensors, and the like.

Figure 7:
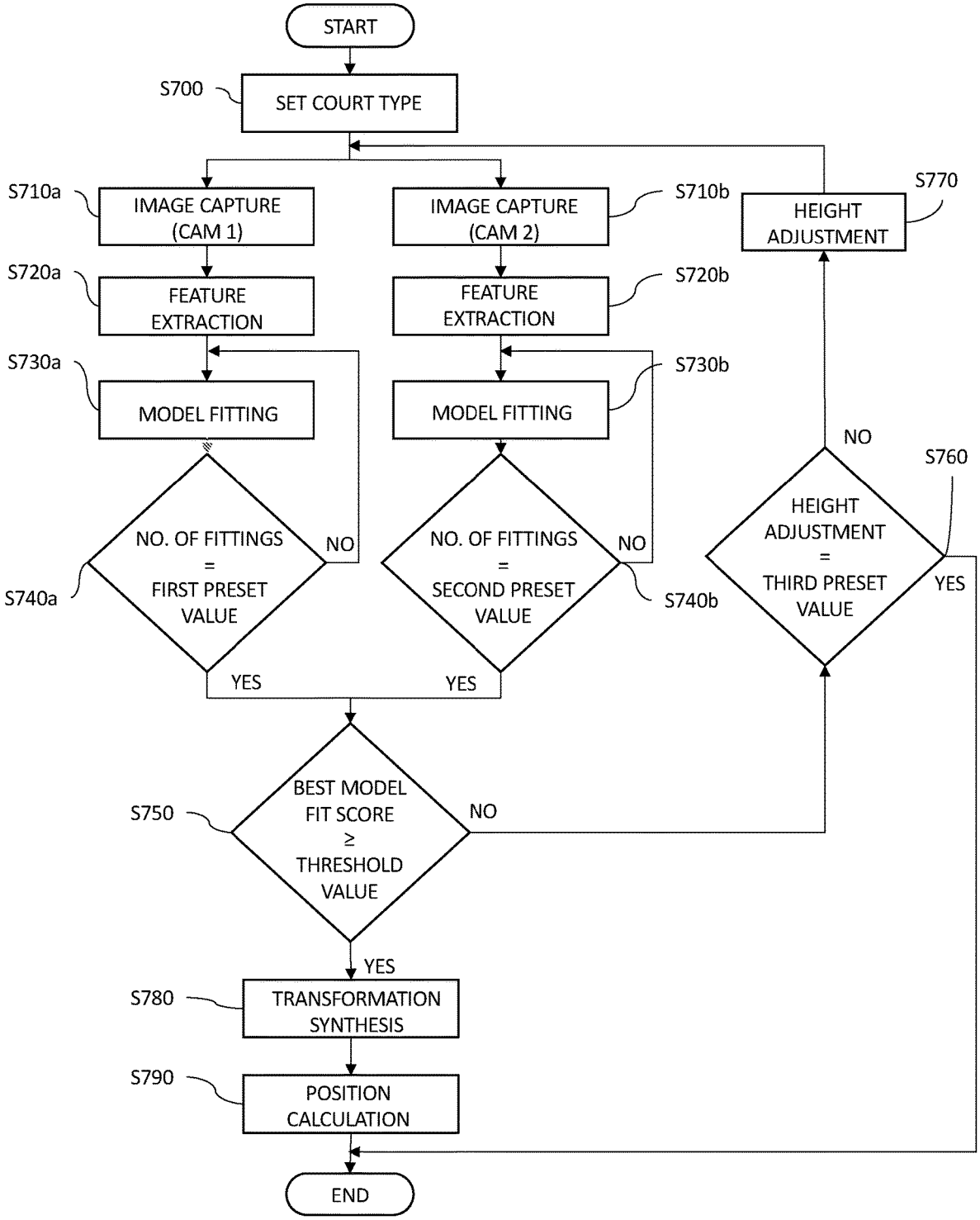
FIG. 7 illustrates a flowchart of an automatic ball machine localization procedure according to example embodiments.

FIG. 7 illustrates a flowchart setting forth exemplary steps of an automatic ball machine localization procedure for automatically determining the location of the automatic ball machine 100 on the court.

As used herein, the term "court" refers to: a flat playing surface including a flat rectangular playing area defined by line markings on the flat playing surface; structures that are a part of the playing area; and enclosures surrounding the playing surface. The line markings may delineate regions within the playing area (e.g., a service box) and boundaries of the playing area (e.g., a side line and a base line) on the playing surface. The playing surface may extend beyond the boundaries of the playing area. Structures that are a part of the playing area may include a net, a cord or cable suspending the net, and net posts to which the net, suspended by the cord or cable, is attached. In racket sports such as platform tennis and padel, wherein the official rules and regulation of the games, provides for a ball to be played off (i.e., come into contact with) an enclosure surrounding the playing surface during regulation game play, the enclosures may be a part of the "court" as used herein. With respect to platform tennis, the enclosure may be comprised of a screen. With respect to padel, the enclosure may be comprised of walls formed of a transparent or opaque material and walls comprised of metal fencing.

The dimensions of a court (i.e., the playing surface, structures that are a part of the playing surface, and enclosures surrounding the playing surface) may be governed through official rules as set forth by governing bodies of the respective racket sports. For example, the dimensions of the court in tennis are set forth by the International Tennis Federation (e.g., 2022 ITF Rules of Tennis), the dimensions of the court in platform tennis are set forth by the American Platform Tennis Association (e.g., Official Rules of Platform Tennis), the dimensions of the court in padel are set forth by the International Padel Federation (e.g., Regulations of the Padel Game), the dimensions of the court in pickleball are set forth by the International Federation of Pickleball (e.g., 2022 Official IFP Rulebook), and the dimensions of POP Tennis are set forth by the International POP tennis Association (e.g., Court and Equipment Guide). Accordingly, the dimensions of a court (i.e., the playing surface, structures that are a part of the playing surface, and enclosures surrounding the playing surface) may be obtained from official rules as set forth by a governing body. The dimensions of a court may also be based on dimensions as specified by a manufacturer of the court. Accordingly, the dimensions of a court may be obtained from a manufacturer specification. The dimensions of a court may also be obtained from measurements taken of a specific court (i.e., an instance of the court).

The dimensions of the court, with respect to the respective different racket sports discussed herein, may be made in reference to any one or combination of the dimensions as specified in the rules issued by the respective governing bodies listed above, dimensions as specified in a manufacturer specification, and dimensions obtained through measurements taken of an instance of a court. The dimensions of a court in relation to a three-dimensional (3D) world coordinate system may be stored as a "court model" in a memory of the automatic ball machine 100.

The composition of the playing surface may be specified in the rules issued by the respective governing bodies listed above, and may include, for example, grass, clay, synthetic or acrylic layers laid on top of a concrete or asphalt foundation, aluminum, etc. The composition of the playing surface may also be specified in a manufacturer specification. The composition of the playing surface may also be determined from an analysis of the instance of the court. Accordingly, the composition of a playing surface, with respect to the respective different racket sports discussed herein, may be made in reference to any one or combination of the composition as specified in the rules issued by the respective governing bodies listed above, the composition as specified in a manufacturer specification, and composition obtained through analysis of an instance of a playing surface of a court. The composition of a playing surface of a court may also be stored as a part of the "court model" in a memory of the automatic ball machine 100.

Prior to executing the automatic ball machine localization procedure as illustrated in FIG. 7, the dimensions of a court in relation to a 3D world coordinate system may be stored as the court model in a memory of the automatic ball machine 100. The memory may store a plurality of court models with each of the plurality of court models corresponding to a specific type of court (or "court type"), such as a tennis court, a platform tennis court, a padel court, a pickleball court, a POP tennis court, etc. Additionally, prior to executing the automatic ball machine localization procedure as illustrated in FIG. 7, intrinsic parameters for the one or more cameras (e.g., the first camera 121 and the second camera 122) included in the imaging system 120 may be stored in the memory of the automatic ball machine 100. With respect to computer vision, the intrinsic parameters of a camera refer to the internal physical parameters of a camera (e.g., focal length, aperture, field-of-view, physical dimensions of each pixel and the exact position of the optical center on the image grid, resolution, radial distortion, etc.) that mathematically characterizes the way that the camera geometrically transforms a point in the 3D world it is imaging (i.e., observing it its field of view) to a pixel in its 2D output image. For example, the pixel coordinate system of a camera is related to the 3D world through the intrinsic parameters of the camera. However, to fully recover the 3D world from the 2D output image, extrinsic camera parameters are also needed. The extrinsic camera parameters refer to the parameters that define the pose (i.e., the position and orientation) of the camera with respect to the 3D world coordinate system.

Referring to FIG. 7, an initial step of the automatic ball machine localization procedure may include placing the automatic ball machine 100 onto the playing surface of a court and adjusting a setting of the automatic ball machine 100 to indicate the type of court (S700). The automatic ball machine 100 may include settings to indicate one of a plurality of types of court (or "court types"). The automatic ball machine 100 may include settings to indicate, for example, one of a tennis court, a platform tennis court, a padel court, a pickleball court, a POP tennis court, etc. For example, a user may place the automatic ball machine 100 onto the playing surface of a platform tennis court and adjust a setting of the automatic ball machine 100 to indicate that the automatic ball machine is located on the playing surface of a platform tennis court.

The automatic ball machine localization procedure further includes capturing a first image (S710*a*) using a first camera (e.g., the first camera 121) of the imaging system 120 and capturing a second image (S710*b*) using a second camera (e.g., the second camera 122 of the imaging system 120) while the automatic ball machine 100 is positioned on the playing surface of the court. For example, the automatic ball machine 100 may be positioned on the playing surface of the court such that the field of view of the first camera 121 and the second camera 122 may include one or more line markings on the flat playing surface, structures that are a part of the playing area, and when present, enclosures surrounding the playing surface. The position of the first camera 121 as disposed on the automatic ball machine 100 may be different from the position of the second camera 122 as disposed on the automatic ball machine 100. For example, the first camera may be positioned a few inches apart from the second camera. Although a first camera 121 and a second camera 122 are disclosed to respectively capture the first image and the second image, according to certain aspects of the invention, a single camera may be used to capture the first image and the second image. For example, a single camera may be used to capture the first image and the second image. For example, the single camera disposed at a first position may capture the first image. Subsequently, the single camera may be shifted to a second position different from the first position, and the single camera disposed at the second position may capture the second image. In another aspect of the present invention, a single stereoscopic camera may be utilized to capture both the first image and the second image without shifting a position of the single stereoscopic camera.

In steps S720*a* and S720*b* a feature extraction process may be performed in which one or more features, may be detected and extracted from the first image (S720*a*) and the second image (S720*b*). The one or more features may include the orientation and location of line markings, intersections of the line markings, vanishing points corresponding to parallel line markings, structures that are a part of the playing area of the court (e.g., a net, net posts, etc.), and, when present, enclosures (e.g., walls) surrounding the playing surface. For example, line markings, the net, the net posts, and walls may be features that are extracted from the first image (S720*a*) and the second image (S720*b*) using line detection techniques, such as Hough transform, a convolution-based operation, etc. The line detection techniques not only detects lines in the first image (S720*a*) and the second image (S720*b*), but also detects intersections of these lines and the orientation of these lines.

In steps S730*a* and S730*b* a model fitting process may be performed to find a transformation from the three dimensional (3D) world coordinate system (i.e., "3D world space" or "world space") of a court model into the image space (i.e., a two dimensional (2D) space that uses pixel coordinates), that most closely aligns with (i.e., "best fits") the extracted features obtained in steps S720*a* and S720*b*. For brevity of explanation, an exemplary situation in which the automatic ball machine 100 is placed onto the playing surface of a platform tennis court and a setting of the automatic ball machine 100 is set to indicate that the automatic ball machine is located on the playing surface of a platform tennis court will be subsequently described. In such an exemplary situation, the model fitting process in step S730*a* may comprise extracting from the court model (i.e., the court model corresponding to a platform tennis court) a number of feature points that correspond to the number of feature points extracted from the first image (S720*a*). In an exemplary situation, in which four feature points, for example, are extracted from the first image, a first set of four feature points may be extracted from the court model. Although, the localization process is described herein with four feature points, aspects of the invention are not limited thereto. For example, five or more features points may be utilized in the process.

The first set of four feature points extracted from the court model may be transformed from a 3D world coordinate system (i.e., "3D world space" or "world space"), into the image space (i.e., a two dimensional (2D) space that uses pixel coordinates) of the first image. With respect to the first image (S730*a*), the first set of four feature points extracted from the court model may be used, together with the four feature points extracted from the first image, to define a projective transformation (homography) between the 3D world space and the image space such that the extracted four feature points of the court model are mapped to the extracted four feature points of the first image.

Using this transformation (e.g., "first transformation"), all points of the court model may be transformed into image space, such that the court model may be superimposed onto the first image. As used herein, a "model fit" may refer to a court model that is superimposed onto an image based on the transformation (i.e., projective transformation). The superimposition of the court model onto the first image (e.g., the first model fit) may be analyzed to determine how well the lines of the transformed court model overlap with the lines in the first image. Each model fit is scored (e.g., associated with a numerical value) according to fit. "Fit" as used herein refers to the degree to which features (e.g., lines) of the transformed court model overlap with the features (e.g., lines) in the first image. For example, a better/best fit corresponds to a higher/highest degree of overlap among the features (e.g., lines) of the transformed court model and those (e.g., lines) in the first image. In this way, a model fit score (e.g., "score 1a") may be generated that corresponds to the degree of fit obtained by the given transformation; i.e. the higher the score the better the fit. This fit score reflects the degree to which the transformation yielding the score accurately represents the true mapping between world space and image space (higher is more accurate).

The model fitting process (S730*a*) may be repeated a plurality of times to generate a corresponding plurality of fit scores (e.g., "score 2a," "score 3a," . . . "score Xa"). Each time the model fitting process (S730*a*) is repeated, a set of feature points (e.g., four feature points), different from previous sets of feature points, are extracted from the court model. As discussed above with respect to the first set of four feature points, the second set of feature points may be transformed (e.g., "second transformation") into image space, such that the court model may be superimposed onto the first image and a model fit score (e.g., a second model fit score "score 2a") may be generated.

The number of times in which the model fitting process in step S730*a* may be repeated may be limited based on a preset value (e.g., a "first preset value"). For example, in step S740*a* an incremental count value (e.g., a "first incremental count value") indicating the number of times of performing step S730*a* may be compared to the first preset value. When the incremental count value is less than the first preset value in step S740*a*, the automatic ball machine localization process may continue such that the model fitting process in step S730*a* is repeated. When the incremental count value is equal to the first preset value in step S740*a*, the best model fit score (e.g., the highest score) from among the plurality of model fit scores (e.g., "score 1a," "score 2a," "score 3a," . . . "score Xa") is selected and the localization process moves to step S750.

A parallel and similar process of model fitting and the generating of a model fit score may be performed based on the court model and the second image (S720*b* and S730*b*). The model fitting process may comprise extracting from the court model (i.e., the court model corresponding to a platform tennis court) a number of feature points that correspond to the number of feature points extracted from the second image (S720*b*). In an exemplary situation, in which four feature points, for example, are extracted from the second image, a set of four feature points may be extracted from the court model. With respect to the second image (S730*b*), the set of four feature points extracted from the court model may be used, together with the four feature points extracted from the second image, to define a projective transformation (homography) between the 3D world space and the image space such that the second set of four feature points extracted from the court model map to the extracted four feature points of the second image.

Using this transformation, all points of the court model may be transformed into image space, such that the court model may be superimposed onto the second image and a model fit score (e.g., score "score 1b") may be generated. Similar to the model fitting process in step S730*a*, the model fitting process in step S730*b* may be repeated a plurality of times to generate a corresponding plurality of fit scores (e.g., "score 2b," "score 3b," . . . "score Xb"). The number of times in which the model fitting process in step S730*b* may be repeated may be limited based on a preset value (e.g., a "second preset value"). For example, in step S740*b* an incremental count value (e.g., a "second incremental count value") indicating the number of times of performing step S730*b* may be compared to the second preset value. When the incremental count value is less than the second preset value in step S740*b*, the automatic ball machine localization process may continue such that the model fitting process in step S730*b* is repeated. When the incremental count value is equal to the second preset value in step S740*b*, the best model fit score (e.g., the highest score) from among the plurality of model fit scores (e.g., "score 1b," "score 2b," "score 3b," . . . "score Xb") is selected and the localization process moves to step S750. The second preset value in step 740*b* may be the same or different from the first preset value in step S740*a*.

In step S750 each of the selected best model fit scores (i.e., the best model fit score selected in step S730*a* and the best model fit score selected in step S730*b*) may be individually compared to a predetermined threshold value to determine if the corresponding transformation is of acceptable accuracy to be used to determine the location of the automatic ball machine 100 on the court. For example, a model fit score equal to or above the predetermined threshold may correspond to a high degree of overlap among the lines of the transformed court model with the lines in the image (i.e., the first image or the second image), and a model fit score below the predetermined threshold may correspond to a low degree of overlap. When one or both of the selected best model fit scores are equal to or greater than the predetermined threshold, step S780 is executed. When both of the selected best model fit scores are less than the predetermined threshold, steps S760 and S770 may be executed such that steps S710*a*-S740*a* may be repeated based on a third image that is different from the first and second images and steps S710*b*-S740*b* may be repeated based on a fourth image that is different from the first, second, and third images. Step S770 may execute a height adjustment of the imaging system 120 such that the third and fourth images may be images taken at a different height with respect to the playing surface than the height at which the first and second images were taken.

The number of times in which the height adjustment process in step S770 may be executed may be limited based on a preset value (e.g., a "third preset value"). For example, in step S760 an incremental count value (e.g., a "third incremental count value") indicating the number of times of performing step S770 may be compared to the third preset value. When the third incremental count value is less than the third preset value in step S760, the automatic ball machine localization process may continue such that the height adjustment process in step S770 may be performed.

When the third incremental count value is equal to the third preset value in step S760, the automatic ball machine localization process may end. When the automatic ball machine localization process is ended based on the third incremental count value being equal to the third preset value in step S760, a message may be output from the automatic ball machine 100 to indicate that the automatic ball machine localization process has failed.

In step S770, a height of the imaging system 120 may be adjusted (e.g., increased or decreased) with respect to the playing surface (e.g., in a Z-direction which is perpendicular to an X-direction and Y-direction in which the playing surface extends). The height of the imaging system 120 may be adjusted (i.e., increased or decreased) through actuation of a height adjustment mechanism, such as height actuator 145. In certain configurations, the position of the imaging system 120 in the x-direction and/or y-direction may also be adjusted in addition to the height of the imaging system 120. Height actuator 145 may comprise, for example, an electromechanical actuator, a linear motor, a rotary motor, or the like. Height actuator 145 may be configured to adjust the height of components of the automatic ball machine 100 simultaneously. For example, the height actuator 145 and the ball launching system 130 may be mechanically coupled or attached to each other. Accordingly, the height actuator 145 may adjust the height of the imaging system 120 and the height of the ball launching system 130 simultaneously. In another embodiment, a separate height adjustment mechanism may be provided for the imaging system 120 and the ball launching system 130. Accordingly, the height of the imaging system 120 and the height of the ball launching system 130 may be adjusted independently of each other.

In step S770 the height of the imaging system 120 may be adjusted in the Z-direction to a height level that is different than the height level at which the first image and the second image are captured. Subsequently, the imaging system 120 captures a plurality of images at the adjusted height level. For example, the first camera 121 may capture a third image and the second camera 122 may capture a fourth image in steps S710*a* and S710*b*, respectively. In addition, steps S720*a*-S740*a*, and S720*b*-S740*b* may be executed as described above. Returning to the description of step S750, when one or both of the selected best model fit scores are equal to or greater than the predetermined threshold, a transformation synthesis process is executed in step S780. The transformation synthesis process in step S780 is a process of combining the transformation corresponding to the model fit having the first selected best model fit score and the transformation corresponding to the model fit having the second selected best model fit score into a single transformation.

In the instance where both of the selected best model fit scores are equal to or above the predetermined threshold of step S750, the transformation corresponding to the model fit having the first selected best model fit score and the transformation corresponding to the model fit having the second selected best model fit score are synthesized. In one embodiment, the transformation synthesis process (S780) may be accomplished by selecting the transformation corresponding to the model fit that yields the higher/highest degree of overlap among the features of the transformed court model and those of the respective image (i.e., selecting as a final model fit, the model fit having the higher score from among the selected best model fit scores). For example, when the difference between both of the selected best model fit scores is greater than or equal to a predetermined value, the transformation synthesis process (S780) may be accomplished by selecting the transformation corresponding to the model fit that yields the higher/highest degree of overlap among the features of the transformed court model and those of the respective image as the final model fit. In another embodiment, the transformation synthesis process may be accomplished by averaging the transformation corresponding to the model fit having the first selected best model fit score and the transformation corresponding to the model fit having the second selected best model fit score and selecting the average as the final model fit. For example, when the difference between both of the selected best model fit scores is less than the predetermined value, the transformation synthesis process (S780) may be accomplished by averaging the transformation corresponding to the model fit having the first selected best model fit score and the transformation corresponding to the model fit having the second selected best model fit score and selecting the average as the final model fit.

In step S790, the synthesized transformation is used together with the intrinsic parameters of the camera to calculate (via geometric transformation) the 3D position of the cameras with respect to the court (using a fixed point on the court as the origin). Because the cameras are physically connected to the automatic ball machine 100 and corresponding components, such as the ball launching system 130, this also yields the position of the automatic ball machine 100 and corresponding components, such as the ball launching system 130 on the playing surface of the court, which completes the localization process.

Figure 8:
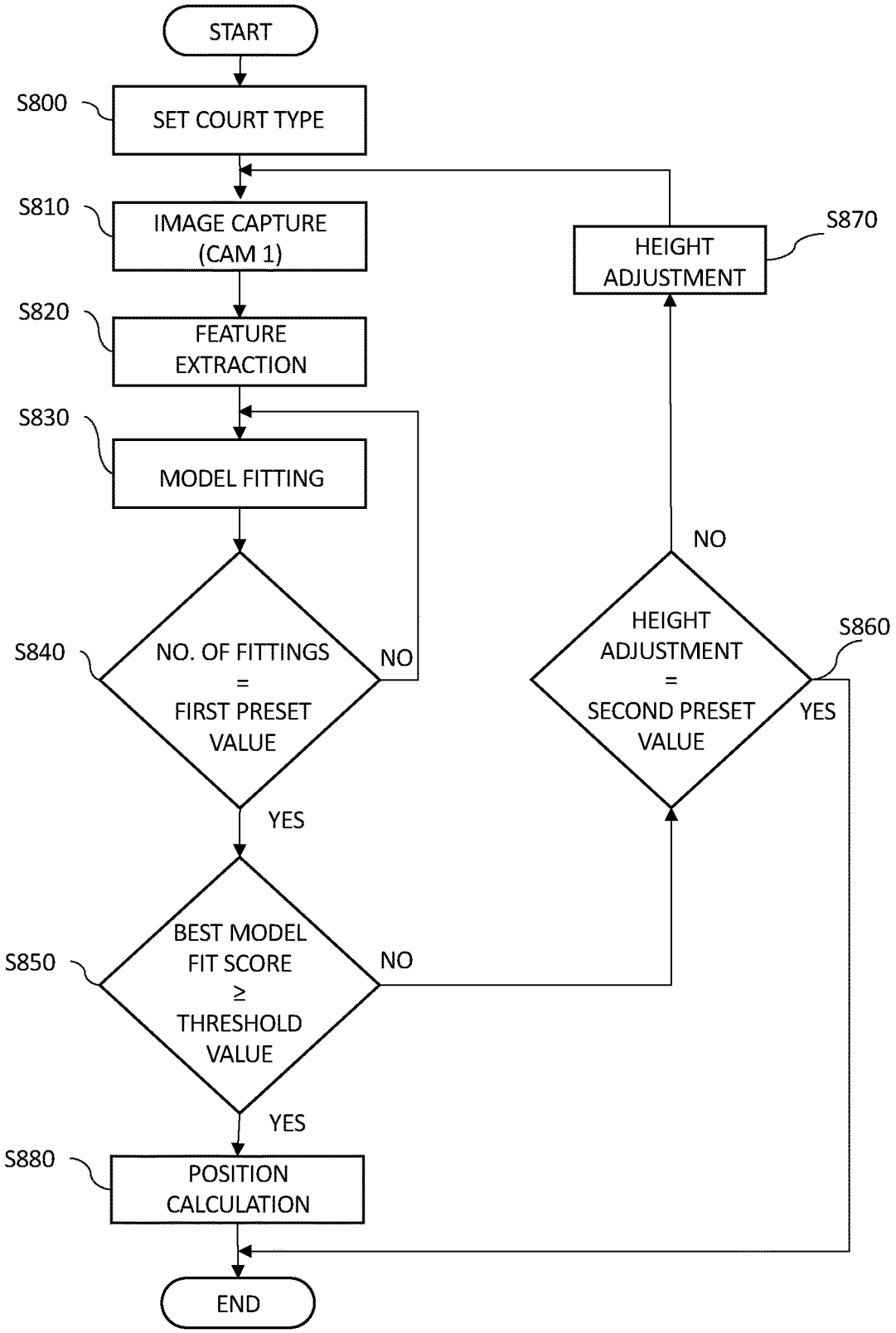
FIG. 8 illustrates a flowchart of an automatic ball machine localization procedure according to example embodiments.

FIG. 8 illustrates a flowchart setting forth exemplary steps of an automatic ball machine localization procedure for automatically determining the location of the automatic ball machine 100 on the court. The automatic ball machine localization procedure set forth in FIG. 8 is similar to the automatic ball machine localization procedure set forth in FIG. 7, except in FIG. 8 the automatic ball machine localization procedure is executed using a single camera and a single image at a given height of the camera.

Referring to FIG. 8, an initial step of the automatic ball machine localization procedure may include placing the automatic ball machine 100 onto the playing surface of a court and adjusting a setting of the automatic ball machine 100 to indicate the type of court (S800). The automatic ball machine localization procedure further includes capturing a first image (S810) using a camera (e.g., the first camera 121) while the automatic ball machine 100 is positioned on the playing surface of the court. In step S820 a feature extraction process may be performed in which one or more features, may be detected and extracted from the first image. In step S830 a model fitting process may be performed to find a transformation from the three dimensional (3D) world coordinate system (i.e., "3D world space" or "world space") of a court model into the image space (i.e., a two dimensional (2D) space that uses pixel coordinates), that most closely aligns with (i.e., "best fits") the extracted features obtained in step S820. Similar to the procedure of FIG. 7, a model fit is obtained and scored (e.g., "score 1").

The model fitting process (S830) may be repeated a plurality of times to generate a corresponding plurality of fit scores (e.g., "score 2," "score 3," . . . "score X"). The number of times in which the model fitting process in step S830 may be repeated may be limited based on a preset value (e.g., a "first preset value"). For example, in step S7840 an incremental count value (e.g., a "first incremental count value") indicating the number of times of performing step S830 may be compared to the first preset value. When the incremental count value is less than the first preset value in step S840, the automatic ball machine localization process may continue such that the model fitting process in step S830 is repeated. When the incremental count value is equal to the first preset value in step S840, the best model fit score (e.g., the highest score) from among the plurality of model fit scores (e.g., "score 1," "score 2," "score 3," . . . "score X") is selected and the localization process moves to step S850.

In step S850 the selected best model fit score is compared to a predetermined threshold value to determine if the corresponding transformation is of acceptable accuracy to be used to determine the location of the automatic ball machine 100 on the court. For example, a model fit score equal to or above the predetermined threshold may correspond to a high degree of overlap among the lines of the transformed court model with the lines in the image, and a model fit score below the predetermined threshold may correspond to a low degree of overlap. When the selected best model fit score is equal to or greater than the predetermined threshold, step S880 is executed. When the selected best model fit score is less than the predetermined threshold, steps S860 and S870 may be executed such that steps S810-S840 may be repeated based on a second image that is different from the first image. Step S870 may execute a height adjustment of the camera such that the second image may be taken at a different height with respect to the playing surface than the height at which the first image was taken.

When the selected best model fit score is equal to or greater than the predetermined threshold, step S880 is executed. In step S880, the transformation corresponding to the selected best model fit score is used together with the intrinsic parameters of the camera to calculate (via geometric transformation) the 3D position of the camera with respect to the court (using a fixed point on the court as the origin). Because the camera is physically connected to the automatic ball machine 100 and corresponding components, such as the ball launching system 130, this also yields the position of the automatic ball machine 100 and corresponding components, such as the ball launching system 130 on the playing surface of the court, which completes the localization process.

Although the above description of the automatic ball machine localization procedures includes computer system resources provided on the automatic ball machine 100, aspects of the invention are not limited to such a description. For example, computer system resources utilized by the automatic ball machine localization procedure may be provided through distributed computing, such as cloud computing. For example, storage of the captured images and computing power to execute the processing steps of the automatic ball machine localization procedure may be provided through distributed computing, such as cloud computing.

As a result of determining the position of the automatic ball machine 100 using the localization procedures as described with respect to FIG. 7 and FIG. 8, the controller 110 has the ability to individually adjust one or more of a speed, tilt, roll, and yaw of the spinner wheels 132*a*, 132*b*, 132*c* to place the balls 101 in an acceptable location for the recipient player. For example, the player (i.e., user) may use a control panel 112 (e.g., touchscreen) and/or a remote wireless device via a network 1900 (FIG. 8), such as a smartphone, to indicate where the player wants a ball 101 placed. The controller 110 may make the appropriate calculations, by solving a ball flight equation, to determine a speed and flight path needed to launch the ball 101 to place the ball 101 at the acceptable location for the recipient player.

For example, the automatic ball machine 100 may allow the player to practice a particular serve type and location on a court. In this example, the player may enter their serve preference and/or location on the court into the controller 110. The controller 110 may further execute software to calculate serving parameters (e.g., ball speed, ball spin, tilt, roll, and yaw) based on the serve preference and/or location entered by the player and the determined location of the automatic ball machine 100 as a result of the localization procedure, and adjust the ball launching system 130 and/or the height actuator 145 to accurately launch the ball 101 to the desired location based on the player serve preference and/or location on the court.

The controller 110 may further use the imaging system 120 and/or other sensor systems (e.g., infrared sensors on the ball launching system 130) to dynamically adjust a speed of the spinner wheels 132*a*, 132*b*, 132*c*, such adjustments may be based on characteristics (e.g., speed, trajectory, etc.) of previous launched ball(s) 101. A common problem with conventional ball machines is that the spinner wheels attached to the motors as part of a ball launch system will wear over time and, as a result, flight of the balls will change over time. For example, with a new ball machine, a spinner motor coupled to a spinner wheel running at half speed may launch the ball 60 ft. However, with worn spinner wheels and the spinner motor running at half speed, the ball might only be launched 56 ft because of a change of trajectory. Such changes in trajectory may also be caused by wear in frame components, wear in bearings of the spinner wheels and/or spinner motors, and/or wear in any other components of the ball machine.

According to aspects of the present invention, the controller 110 may further use the imaging system 120 to determine the location of the ball 101 after being launched and determine if the ball 101 does not end up at the desired location, to further determine a location error. The controller 110 may dynamically adjust or calibrate one or more of a launch orientation (e.g., tilt, roll, and yaw) and a speed of the spinner wheels 132*a*, 132*b*, 132*c* to compensate for this location error such that a subsequent ball(s) 101 will be launched to the desired location. This process may be performed continuously, such that the controller 110 is continuously determining if location error exists for a ball launch, and continuously compensating for this location error.

The controller 110 may further use the imaging system 120 for safety. The controller 110 may use a field of vision of the imaging system 120 to detect if the ball's 101 flight is obstructed by an object, such as a person walking in front of the automatic ball machine 100. The controller 110 may withhold launching of the ball 101 as a safety measure to avoid hitting the object. Thus, by utilizing a field of vision depth estimation capabilities of the imaging system 120, if the controller 110 detects anyone (or anything) that is unexpected, the controller 110 may withhold/avoid throwing the ball 101 as a safety measure. For example, the automatic ball machine 100 may dynamically stop the first, second, third spinner wheels 132*a*, 132*b*, 132*c* to prevent the ball from being launched.

The controller 110 may further use the imaging system 120 to adapt launching based on a particular player. For example, the automatic ball machine 100 may launch a responsive shot that would be representative of an opponent, for the person using it. Typically, all actions start with ball machines launching a ball. If a player wants to practice hitting a follow-up shot to a tennis serve, it is impossible with typical ball machines.

According to aspects of the present invention, the automatic ball machine 100 may be placed where a typical service returner would stand. When the player serves the ball, the controller 110, via the imaging system 120, may identify a ball 101 flight and speed of the serve and make a representative return shot. In at least one configuration, the automatic ball machine 100 may adjust a height of the ball launching system 130 using the height actuator 145 to thereby change the release point for the ball 101 and the ball's 101 trajectory. The representative return shot includes timing the return ball 101 so it coincides, time wise, with a return, the controller 110 adjusting, via the height actuator 145, a height of the ball launching system 130 so an ejection point is at an appropriate height of where a returner would hit it, and adjusting a speed at which the ball launching system 130 launches a return shot that would be representative of one that a returner could hit. For example, a slow, low serve typically cannot be driven back at the player, as a result of the return pace being limited by the slow speed and low trajectory of the incoming serve. However, a hard hit serve, with a high bounce, may be returned at a much faster rate. The automatic ball machine 100 may make adjustments based on these types of serve coming at it.

The controller 110 may further use the imaging system 120 to detect a visual indication in a field of vision of the imaging system 120 to trigger the ball 101 being launched. The controller 110 may detect and understand basic player positioning and determine when the player is ready to receive the ball 101. The controller 110 may then trigger the ball launching system 130 to launch the ball. Typical ball machines send balls either by a coach directly feeding them into the ball machine or based on a timer (e.g., one ball every 10 seconds). For example, the automatic ball machine 100 may wait until a player's posture is detected as being in a service return position. Alternatively, the visual indicator that the automatic ball machine 100 detects to trigger a ball 101 launch may be based on a gesture or movement of the player. The gesture may be customizable through the controller and may include, for example, a hand gesture of the player.

The controller 110 may further use the imaging system 120 to detect a location of the player receiving the ball 101. This allows the automatic ball machine 100 to dynamically place the ball 101 relative to the player to practice different shots, regardless of where they are starting from. Typical ball machines just repeat the same shot. If the player desires to practice a wide backhand 4' away, the player practicing may "cheat" and when they reset, they drift closer to where the ball flight will be. The automatic ball machine 100 may consistently place the ball 101 4' wide of the player, regardless of where the player is standing. Thus, the player drifting in their setup will have a benefit of being launched the ball 101 that is 4' away regardless of where they drift to, leading to a better, more consistent, practice experience.

The controller 110 may further use the imaging system 120 to track return flight of the ball 101 from the player and provide ball 101 flight analytics on a practice session. Typical practice sessions using a typical ball machine do not yield performance data on performance of the player. The player cannot measure their performance from hitting balls launched by the typical ball machine. Using the above scenario, the player practicing a backhand 4' away, the player may receive a report from the automatic ball machine 100 after their practice session that details their performance. For example, the automatic ball machine 100 may detail how and how many balls 101 are returned, average speed of the returned balls 101, where did the return balls 101 go, and any another other analytic information from their practice session that is beneficial to the player.

The controller 110 may further use the imaging system 120 to learn aspects of the games they are helping to train. This may include a starting position of the player(s), scenarios for common responsive shots, etc. For example, if a soft serve is low, the automatic ball machine 100 would know the possible returns and provide one accordingly, with only a certain set of shots that are possible. In another example, if the player serves and rushes the net, the automatic ball machine 100 may lob the ball 101 over the player's head instead of driving it past them.

In at least one configuration, the controller 110 may include a regenerative charging circuit. The controller 110 may perform dynamic braking, via the regenerative charging circuit, of the spinner wheels 132*a*, 132*b*, 132*c* to rapidly change their speeds to exact RPMs. Typical ball machines will coast when a player changes its dial settings, e.g., if the typical ball machine goes from a speed of 100% to 50% it takes a very long time for the motor to "settle." In the dynamic braking process performed by the controller 110, excess kinetic energy is captured/harvested and stored in a battery 125 via the regenerative charging circuit 114. This dynamic braking process allows the controller 110 to rapidly change the speed of the first, second, third spinner motors to set exact speeds to hit desired ball 101 flight paths, without consuming excess electrical energy.

In at least one configuration, the automatic ball machine 100 may further include a microphone (not illustrated) that allows the automatic ball machine 100 to be controlled by verbal commands. The controller 110 may receive sound data from the microphone and convert that sound data into the verbal commands. For example, when the player is getting a lesson, the automatic ball machine 100 may be easily started and stopped to allow the player to get instruction(s). Typically, this may be done with a phone app, but using a phone app is inconvenient in that the phone must be carried in the player's pocket while training. The automatic ball machine 100 makes this process more convenient, for example the player could say "Volley Stop" or "Volley Start". In at least one configuration, the automatic ball machine 100 may be "named" by the player, such that a plurality of automatic ball machines 100 may be differentiated when players give commands. For example, the automatic ball machine 100 could be named after actual tennis players, such as Williams, Sampras, Djokovic, or any other actual tennis player. In at least one configuration, the automatic ball machine 100 may establish a data connection between a player device (e.g., phone, headset, etc.) to improve accuracy of perceived commands given to the automatic ball machine 100 from the player device. This would prevent triggering another machine ball 100 on an adjacent court.

In at least one configuration, the automatic ball machine 100 may communicate with another ball machine 100. For example, a plurality of automatic ball machines 100 may be placed on the playing surface to get a more realistic training experience. The automatic ball machines 100 may communicate and coordinate with each other to determine which specific ball machine 100 will respond to a particular ball 101 being hit toward the automatic ball machines 100. For example, several machines 100 may be placed on the playing surface (e.g., three across the baseline in tennis) and when the player hits a wide shot, the automatic ball machine 100 closest will be the one to return a ball 101. This would allow the player to play a virtual match against a series of ball machines 100, and have the play be realistic.

Figure 9:
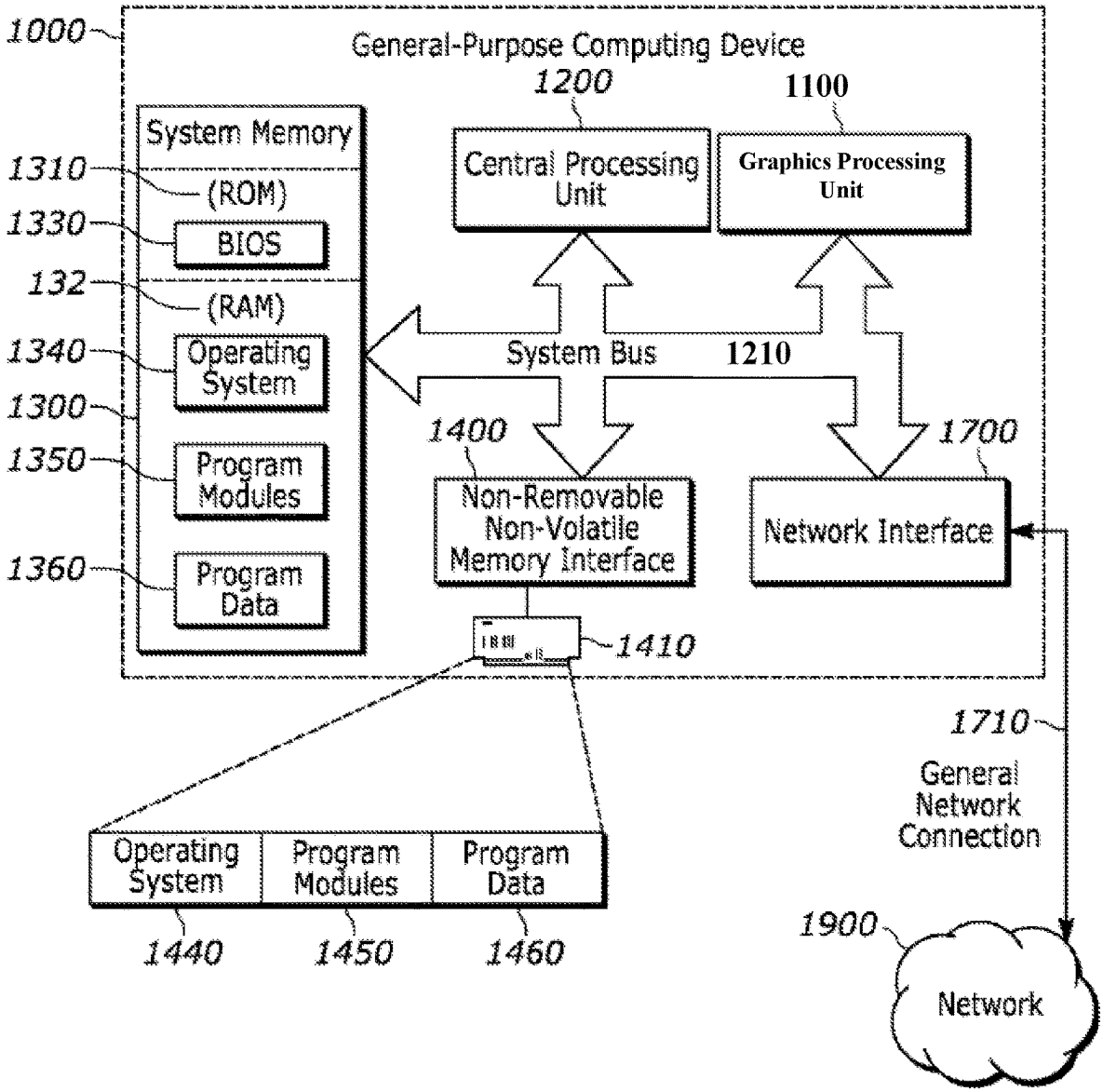
FIG. 9 illustrates an example general-purpose computing device for use with the automatic ball according to example embodiments.

With reference to FIG. 9, an exemplary general-purpose computing device is illustrated in the form of the exemplary general-purpose computing device 1000. The general-purpose computing device 1000 may be of the type utilized for the controller 110 (FIGS. 1-6) as well as the other computing devices with which the controller 110 may communicate through a communication network 1900. As such, it will be described with the understanding that variations may be made thereto. The exemplary general-purpose computing device 1000 may include, but is not limited to, one or more graphics processing units (GPUs) 1100, one or more central processing units (CPUs) 1200, a system memory 1300, such as including a Read Only Memory (ROM) 1310 to store a Basic Input/Output System (BIOS) 1330 and a Random Access Memory (RAM) 1320, and a system bus 1210 that couples various system components including the system memory to the CPU(s) 1200. The system bus 1210 may be any of several types of bus structures including a memory bus or memory controller, a peripheral bus, and a local bus using any of a variety of bus architectures. Depending on the specific physical implementation, one or more of the GPUs 1100, CPUs 1200, the system memory 1300 and other components of the general-purpose computing device 1000 may be physically co-located, such as on a single chip. In such a case, some or all of the system bus 1210 may be communicational pathways within a single chip structure.

The general-purpose computing device 1000 also typically includes computer readable media, which may include any available media that may be accessed by the general-purpose computing device 1000. By way of example, and not limitation, computer readable media may comprise computer storage media and communication media. Computer storage media includes media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which may be used to store the desired information and which may be accessed by the general-purpose computing device 1000. Communication media typically embodies computer readable instructions, data structures, program modules or other data in a modulated data signal such as a carrier wave or other transport mechanism and includes any information delivery media. By way of example, and not limitation, communication media includes wired media such as a wired network or direct-wired connection, and wireless media such as acoustic, RF, infrared and other wireless media. Combinations of any of the above should also be included within the scope of computer readable media.

When using communication media, the general-purpose computing device 1000 may operate in a networked environment via logical connections to one or more remote computers. The logical connection depicted in FIG. 8 is a general network connection 1710 to the network 1900, which may be a local area network (LAN), a wide area network (WAN) such as the Internet, or other networks. The computing device 1000 is connected to the general network connection 1710 through a network interface or adapter 1700 that is, in turn, connected to the system bus 1210. In a networked environment, program modules depicted relative to the general-purpose computing device 1000, or portions or peripherals thereof, may be stored in the memory of one or more other computing devices that are communicatively coupled to the general-purpose computing device 1000 through the general network connection 1710. It will be appreciated that the network connections shown are exemplary and other means of establishing a communications link between computing devices may be used.

The general-purpose computing device 1000 may also include other removable/non-removable, volatile/nonvolatile computer storage media. By way of example only, FIG. 9 illustrates a hard disk drive 1410 that reads from or writes to non-removable, nonvolatile media. Other removable/non-removable, volatile/nonvolatile computer storage media that may be used with the exemplary computing device include, but are not limited to, magnetic tape cassettes, flash memory cards, digital versatile disks, digital video tape, solid state RAM, solid state ROM, and the like. The hard disk drive 1410 is typically connected to the system bus 1210 through a non-removable memory interface such as interface 1400.

The drives and their associated computer storage media discussed above and illustrated in FIG. 9, provide storage of computer readable instructions, data structures, program modules and other data for the general-purpose computing device 1000. In FIG. 9, for example, hard disk drive 1410 is illustrated as storing operating system 1440, other program modules 1450, and program data 1460. Note that these components may either be the same as or different from operating system 1340, other program modules 1350 and program data 1360, stored in RAM 1320. Operating system 1440, other program modules 1450 and program data 1460 are given different numbers here to illustrate that, at a minimum, they are different copies.

With reference to FIGS. 1-6, again, the foregoing description applies to the controller 110, as well as to any other computing devices in communication with the controller 110 through the network 1900. The network interface 1700 facilitates outside communication in the form of voice and/or data. For example, the network interface 1700 may include a connection to a Plain Old Telephone Service (POTS) line, or a Voice-over-Internet Protocol (VOIP) line for voice communication. In addition, the network interface 1700 may be configured to couple into an existing network, through wireless protocols (Bluetooth, 802.11a, ac, b, g, n, or the like) or through wired (Ethernet, or the like) connections, or through other more generic network connections. In still other configurations, a cellular link may be provided for both voice and data (i.e., GSM, CDMA or other, utilizing 2G, 3G, 4G, and/or 5G data structures and the like). The network interface 1700 is not limited to any particular protocol or type of communication. It is, however, preferred that the network interface 1700 be configured to transmit data bi-directionally, through at least one mode of communication. The more robust the structure of communication, the more manners in which to avoid a failure or a sabotage with respect to communication, such as to collect healthcare information in a timely manner.

The program modules 1350 comprises a user interface which may configure the automatic ball machine 100. In many instances, the program modules 1350 comprises a keypad with a display that is connected through a wired/wireless connection with the controller 110. With the different communication protocols associated with the network interface 1700, the program modules 1350 may comprise a wireless device that communicates with the CPUs 1200 through a wireless communication protocol (i.e., Bluetooth, RF, WIFI, etc.). In other configurations, the program modules 1350 may comprise a virtual programming module in the form of software that is on, for example, a smartphone, in communication with the network interface 1700. In still other configurations, such a virtual programming module may be located in the cloud (or web based), with access thereto through any number of different computing devices. Advantageously, with such a configuration, the player may communicate with the automatic ball machine 100 remotely, with the ability to change functionality.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A ball machine system comprising:

a ball launching system;

a memory configured to store a court model that includes dimensions of a court type in relation to a three-dimensional (3D) coordinate system;

an imaging system connected to the ball launching system and configured to capture a plurality of images of a court; and a processor configured to analyze the plurality of images to detect feature points in each of the plurality of images, superimpose a plurality of different transformations of the court model onto the plurality of images to generate a plurality of model fits, select as a final model fit, from the plurality of model fits, a model fit based on a degree of overlap among features of the transformed court model and the respective image, and calculate the position of the ball launching system on a playing surface of the court based on the selected final model fit and intrinsic parameters of the imaging system.

2. The ball machine system of claim 1, wherein when a plurality of model fits each have a degree of overlap greater than a predetermined threshold, select as the final model fit, the model fit having the greater degree of overlap, or select as the final model fit, the average of the plurality of model fits having a degree of overlap greater than the predetermined threshold.

3. The ball machine system of claim 1, wherein the processor is further configured to control settings of the ball launching system based on the calculated position of the ball launching system on the playing surface.

4. The ball machine system of claim 3, wherein the settings include the speed, and magnitude and orientation of spin of balls launched from the ball launching system.

5. The ball machine system of claim 3, wherein the settings include a target landing location of the balls launched from the ball launching system.

6. The ball machine system of claim 1 further comprising:

a height actuator configured to adjust a height of the imaging system.

7. The ball machine system of claim 6, wherein a first subset of the plurality of images are captured at a first height in relation to a playing surface of the court and a second subset of the plurality of images are captured at a second height in relation to a playing surface of the court, and wherein the first height is different from the second height.

8. A ball machine system comprising:

a ball launching system;

a memory configured to store a court model that includes dimensions of a court type in relation to a three-dimensional (3D) coordinate system;

an imaging system connected to the ball launching system and configured to capture a plurality of images of a court; and a processor configured to analyze the plurality of images to detect features including a plurality of lines, the orientation of the plurality of lines, and intersection points among the plurality of lines, extract, as feature points, from each of the plurality of images the detected features corresponding to each image, superimpose, based on a selection of a first set of feature points from the court model and the extracted feature points from a first image included in the plurality of images, a first transformation of the court model onto the first image to generate a first model fit, superimpose, based on a selection of a second set of feature points from the court model and the extracted feature points from a second image included in the plurality of images, a second transformation of the court model onto the first image to generate a second model fit, determine, for the first model fit, a degree of overlap among features of the first transformation of the court model with features in the first image, determine, for the second model fit, a degree of overlap among features of the second transformation of the court model with features in the second image, select as a final model fit, a model fit based on a degree of overlap, and calculate the position of the ball launching system on a playing surface of the court based on the selected final model fit and intrinsic parameters of the imaging system.

9. The ball machine system of claim 8, wherein when a plurality of model fits each have a degree of overlap greater than a predetermined threshold, select as the final model fit, the model fit having the greater degree of overlap, or select as the final model fit, the average of the plurality of model fits having a degree of overlap greater than the predetermined threshold.

10. The ball machine system of claim 8, wherein the processor is further configured to control settings of the ball launching system based on the calculated position of the ball launching system on the playing surface.

11. The ball machine system of claim 10, wherein the settings include the speed and magnitude and orientation of spin of balls launched from the ball launching system.

12. The ball machine system of claim 10, wherein the settings include a target landing location of the balls launched from the ball launching system.

13. The ball machine system of claim 8 further comprising:

a height actuator configured to adjust a height of the imaging system.

14. The ball machine system of claim 13, wherein a first subset of the plurality of images are captured at a first height in relation to a playing surface of the court and a second subset of the plurality of images are captured at a second height in relation to a playing surface of the court, and wherein the first height is different from the second height.

15. The ball machine system of claim 8, wherein the first transformation and the second transformation are projective transformations.

16. A method of determining the position of a ball machine on a playing surface of a court, the method comprising:

selecting a court model that includes dimensions of a court type in relation to a three-dimensional (3D) coordinate system;

analyzing a plurality of images captured by an imaging system attached to the ball machine to detect feature points in each of the plurality of images;

superimposing a plurality of different transformations of the court model the plurality of images to generate a plurality of model fits;

selecting as a final model fit, from the plurality of model fits, a model fit based on a degree of overlap among features of the transformed court model and the respective image; and calculating the position of the ball machine on the playing surface based on the selected final model fit and intrinsic parameters of the imaging system.

17. The method of claim 16, wherein when a plurality of model fits each have a degree of overlap greater than a predetermined threshold, selecting as the final model fit, the model fit having the greater degree of overlap, or selecting as the final model fit, the average of the plurality of model fits having a degree of overlap greater than the predetermined threshold.

18. The method of claim 16, further comprising:

controlling settings of a ball launching system based on the calculated position of the ball machine on the playing surface.

19. The method of claim 18, wherein the settings include the speed, and magnitude and orientation of spin of balls launched from the ball launching system.

20. The method of claim 18, wherein the settings include a target landing location of the balls launched from the ball launching system.

21. The method of claim 16, further comprising:

adjusting a height of the imaging system, wherein a first subset of the plurality of images are captured at a first height in relation to a playing surface of the court and a second subset of the plurality of images are captured at a second height in relation to a playing surface of the court, and wherein the first height is different from the second height.

22. A method of determining the position of a ball machine on a playing surface of a court, the method comprising:

selecting a court model that includes dimensions of a court type in relation to a three-dimensional (3D) coordinate system;

analyzing a plurality of images captured by an imaging system attached to the ball machine to detect features including a plurality of lines, the orientation of the plurality of lines, and intersection points among the plurality of lines;

extracting, as feature points, from each of the plurality of images the detected features corresponding to each image;

superimposing, based on a selection of a first set of feature points from the court model and the extracted feature points from a first image included in the plurality of images, a first transformation of the court model onto the first image to generate a first model fit;

superimposing, based on a selection of a second set of feature points from the court model and the extracted feature points from a second image included in the plurality of images, a second transformation of the court model onto the first image to generate a second model fit;

determining, for the first model fit, a degree of overlap among features of the first transformation of the court model with features in the first image;

determining, for the second model fit, a degree of overlap among features of the second transformation of the court model with features in the second image;

selecting as a final model fit, a model fit based on a degree of overlap; and calculating the position of the ball machine on the playing surface based on the selected final model fit and intrinsic parameters of the imaging system.

23. The method of claim 22, wherein when a plurality of model fits each have a degree of overlap greater than a predetermined threshold, selecting as the final model fit, the model fit having the greater degree of overlap, or selecting as the final model fit, the average of the plurality of model fits having a degree of overlap greater than the predetermined threshold.

24. The method of claim 22, further comprising:

controlling settings of the ball launching system based on the calculated position of the ball machine on the playing surface.

25. A ball machine system comprising:

a ball launching system;

a memory configured to store a court model that includes dimensions of a court type in relation to a three-dimensional (3D) coordinate system;

a camera connected to the ball launching system and configured to capture an image of a court; and a processor configured to analyze the image to detect feature points in the image, superimpose a plurality of different transformations of the court model onto the image to generate a plurality of model fits, select as a final model fit, from the plurality of model fits, a model fit based on a degree of overlap among features of the transformed court model and the image, and calculate the position of the ball launching system on a playing surface of the court based on the selected final model fit and intrinsic parameters of the camera.

26. The ball machine system of claim 25, wherein the processor is further configured to control settings of the ball launching system based on the calculated position of the ball launching system on the playing surface.

27. The ball machine system of claim 26, wherein the settings include the speed, and magnitude and orientation of spin of balls launched from the ball launching system.

28. The ball machine system of claim 26, wherein the settings include a target landing location of the balls launched from the ball launching system.

29. A ball machine system comprising:

a ball launching system;

a memory configured to store a court model that includes dimensions of a court type in relation to a three-dimensional (3D) coordinate system;

a camera connected to the ball launching system and configured to capture images of a court;

a height actuator configured to adjust a height of the camera; and a processor configured to analyze a first image captured by the camera at a first height and a second image captured by the camera at a second height to detect feature points in the first image and the second image, superimpose a plurality of different transformations of the court model onto the first image and the second image to generate a plurality of model fits, select as a final model fit, from the plurality of model fits, a model fit based on a degree of overlap among features of the transformed court model with respect to the first image and the second image, and calculate the position of the ball launching system on a playing surface of the court based on the selected final model fit and intrinsic parameters of the camera.

30. The ball machine system of claim 29, wherein the processor is further configured to control settings of the ball launching system based on the calculated position of the ball launching system on the playing surface.

31. The ball machine system of claim 30, wherein the settings include the speed, and magnitude and orientation of spin of balls launched from the ball launching system.

32. The ball machine system of claim 30, wherein the settings include a target landing location of the balls launched from the ball launching system.

* * * * *